US005598589A

United States Patent [19]

Frettoli

[11] Patent Number: 5,598,589

[45] Date of Patent: Feb. 4, 1997

[54] HINGE DEVICE FOR SECURING THE SEAT AND LID TO A WATER CLOSET PAN

[75] Inventor: Domenico Frettoli, Brescia, Italy

[73] Assignee: Ideal Standard SPA, Milan, Italy

[21] Appl. No.: 367,161

[22] PCT Filed: Jun. 10, 1993

[86] PCT No.: PCT/IT93/00059

§ 371 Date: Jan. 9, 1995

§ 102(e) Date: Jan. 9, 1995

[87] PCT Pub. No.: WO94/01033

PCT Pub. Date: Jan. 20, 1994

[30] Foreign Application Priority Data

Jul. 9, 1992 [IT] Italy ..... RE920061 U

[51] Int. Cl.[6] ..... A47K 13/12

[52] U.S. Cl. ..... 4/236

[58] Field of Search ..... 4/234, 236, 237, 4/240

[56] References Cited

U.S. PATENT DOCUMENTS

| | | | |
|---|---|---|---|
| 2,355,378 | 8/1944 | Jacobs | 4/234 |
| 3,754,300 | 8/1973 | Shepherd | 4/236 X |
| 3,820,175 | 6/1974 | Waldon | 4/236 |
| 4,467,481 | 8/1984 | Ginsburg . | |
| 4,939,796 | 7/1990 | Pepper | 4/236 |
| 4,958,387 | 9/1990 | Fait | 4/236 |

FOREIGN PATENT DOCUMENTS

| | | | |
|---|---|---|---|
| 1144706 | 4/1983 | Canada | 4/240 |
| 0225427 | 6/1987 | European Pat. Off. . | |
| 0349025 | 1/1990 | European Pat. Off. . | |
| 2354021 | 12/1977 | France . | |
| 2433922 | 4/1980 | France | 4/236 |
| 1654805 | 3/1971 | Germany | 4/236 |

*Primary Examiner*—Charles E. Phillips

*Attorney, Agent, or Firm*—Birch, Stewart, Kolasch & Birch, LLP

[57] ABSTRACT

A hinge device for securing the seat and lid to a water-closet pan includes a first part with a first portion fixed in a position in the vertical plane of symmetry of the pan and a second portion, joined to the first portion. A second part is provided which is fixed to the lid with rear edges hinged to the second portion of the first part by two first pins of horizontal axis. The seat includes a rear end hinged to the second portion of the first part by two second pins of the horizontal axis, the second pins lie in a position lower and to the front of the first pins. Only one hinge device is used for securing the seat and lid to the pan. A third part of plate form is provided to be fixed to the seat and having its rear edge hinged to the second portion of the first part by a single pin of horizontal axis. The second part of plate form includes a single part which is hinged to the second portion of the first part by a single first pin.

3 Claims, 2 Drawing Sheets

HINGE DEVICE FOR SECURING THE SEAT AND LID TO A WATER CLOSET PAN

BACKGROUND OF THE INVENTION

1. Field of the Invention

This invention relates to hinge devices for securing the corresponding seat and lid to water closet pans.

2. Description of Background Art

For this purpose it is known to use two hinge devices fixed to the upper rear part of the pan, each of the hinge devices include a single pin by which the device is hinged both to the lid and to the seat. A single hinge device for securing the lid and seat to a water closed pan, where the lid and seat rotate around two different axis is disclosed in EP-A-0225427.

The device disclosed in EP-A-0225427 includes a first part with a first portion to be fixed in a position in the vertical plane of symmetry of the pan and a second portion, joined to the first portion; second parts to be fixed to the lid and having their rear edge hinged to the second portion of the first part by two first pins each having a horizontal axis; the seat having its rear end hinged to the second portion of the first part by two second pins of a horizontal axis, said second pins lying in a position lower and to the front of the first pins.

OBJECT AND SUMMARY OF THE INVENTION

The object of the present invention is to improve said known securing devices in such a manner so as to satisfy the following various requirements: that the hinge device is a single device to be fitted in a position in the vertical plane of symmetry, of the pan, that it is able to simultaneously secure the seat and lid to the pan, and that it is of particularly pleasing appearance.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
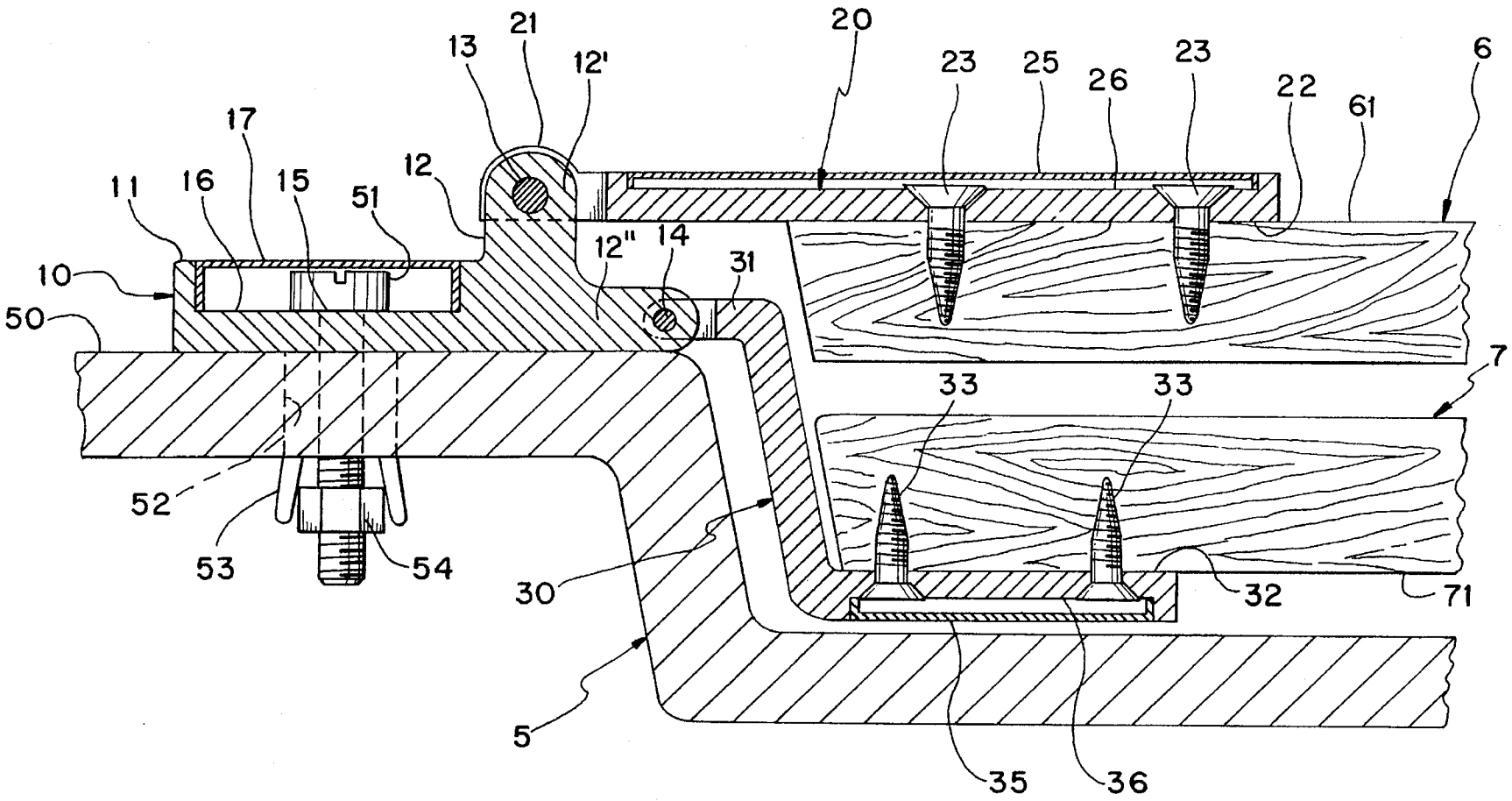
FIG. 1 is a sectional view on the vertical plane of symmetry of the device of the invention, shown fitted to a pan, a seat and a lid.
Figure 2:
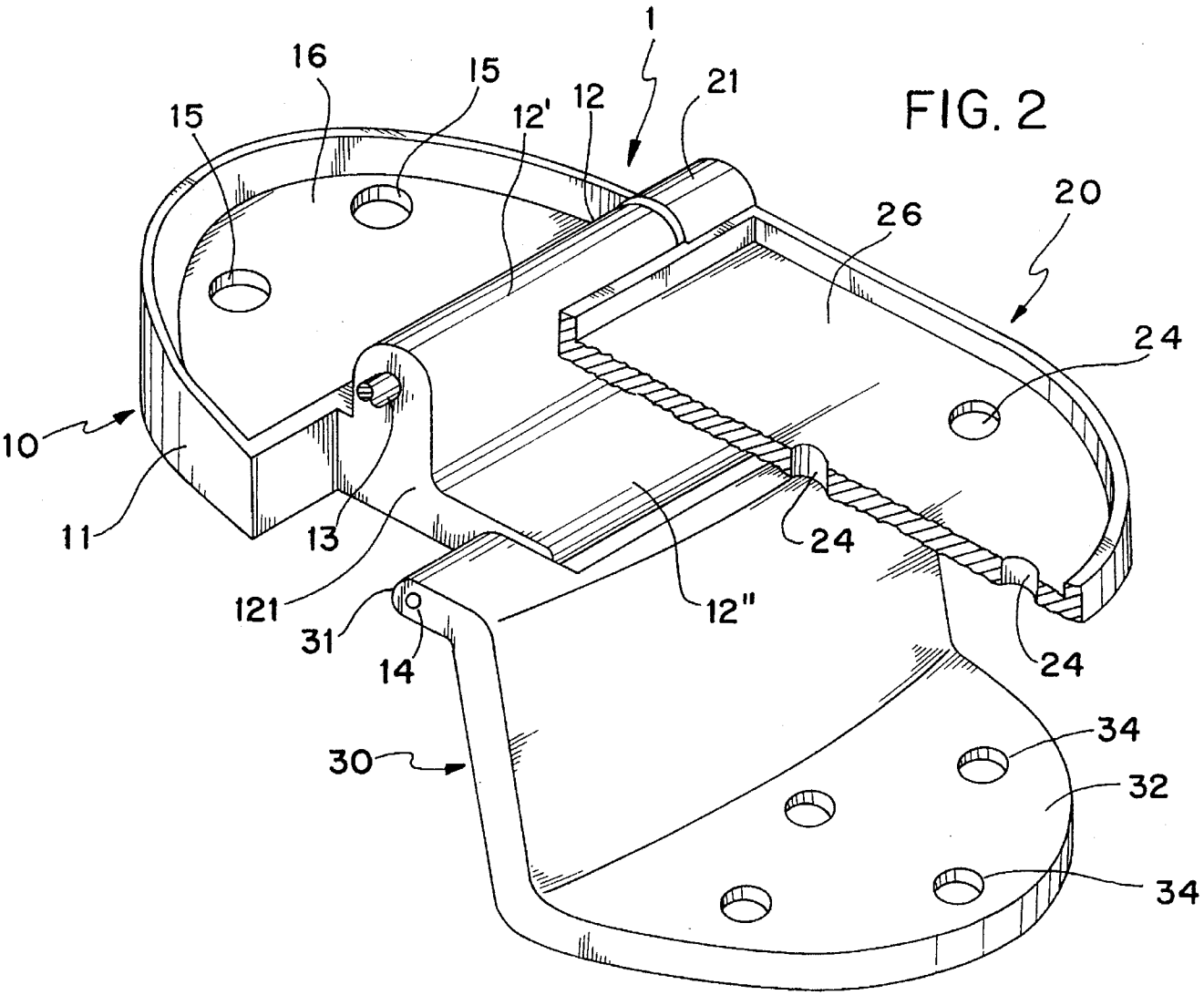
FIG. 2 is a perspective view of the hinge device of FIG. 1.

The hinge device of the invention, indicated overall by 1 in FIGS. 1 and 2, is intended to be fixed to a water closet pan 5 in a position in the vertical plane of symmetry of the pan 5, and acts as the only securing means for the lid 6 and seat 7.

The device 1 includes a first part 10 with a first portion 11 of plate form to be fixed onto the upper rear surface 50 of the pan 5, and a second portion 12 joined to the first portion 11.

The device 1 also includes a second part 20 of plate form to be fixed to the lid 6, and a third part 30, also of plate form, to be fixed to the seat 7. The second part 20 has its rear edge hinged to the second portion 12 of the first part 10 by a first pin 13 of a horizontal axis. The third part 30 has its rear edge hinged to the second portion 12 of the first part 10 by a second pin 14 of a horizontal axis. The second pin 14 lies in a geometrical position which is lower than and to the front of the first pin 13. The second portion 12 of the part 10 comprises two opposing vertical walls 121, external to which projects the end portions of the two pins 13 and 14. The rear edge of each part 20 and 30 comprises two rearwardly projecting flanges, indicated respectively by 21 and 31, which embrace the portion 12 of the part 10 and comprise cylindrical seats to receive said end portions of the two pins 13 and 14.

The portion 12 comprises a first upwardly extending projection 12', the upper end region of which comprises the seat for the pin 13, and a second horizontally forward extending projection 12", the front end region of which comprises the seat for the pin 14. The first projection 12' joins the second projection 12" at a right angle with respect to a section taken on the vertical plane of symmetry.

The first part 10 is fixed onto the surface 50 of the pan 5 by usual means, such as so-called "expansion screws", namely, screws 51 the shank of which passes through a respective hole 15 provided in the portion 11 and a respective hole 52 provided in the pan 5, and is inserted through an expansion plug 53 which is inserted into the hole 52 and expanded and hence rendered rigid with the hole 52 by tightening a lower nut 54 screwed onto the shank of the screw 51.

The second part 20 is of a flat plate form and is fixed with its lower face 22 against the upper surface 61 of the lid 6 by screws 23 which pass through holes 24 provided in the part 20.

The third part 30 is in the form of a plate bent to an L-shape and is fixed with the upper face 32 of its end portion against the lower surface 71 of the seat 7 by screws 33 which pass through holes 34 provided in the part 30.

The upper face 26 of the part 20, where the holes 24 are provided, and the lower face 36 of the part 30, where the holes 34 are provided, are slightly recessed and are covered with suitable covers 25 and 35 respectively for the aesthetic purpose of covering the heads of the screws 23 and 33, respectively. The upper face 16 of the portion 11, where the holes 15 are provided, is also slightly recessed and is covered with a cover 17 for the aesthetic purpose of covering the heads of the screws 51. The sectional profile, FIG. 1, of the part 30 is matched to the profile of the upper surface of the pan 5, so that when the seat 7 has been hinged by the device 1, it is parallel to the pan 5 and slightly spaced from the upper rear surface thereof. The device of the invention enables the lid 6 and seat 7 to be fitted to the respective pan 5 in a simple and rational manner, in that it is a single device and can be fitted to the pan by simple screws.

In addition, the appearance of the pan with its fitted seat and lid is particularly pleasing, by virtue of the device of the invention.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A hinge device for securing a seat and a lid to a water-closet pan comprising:

a first part including a first portion adapted to be fixed in a position in the vertical plane of symmetry of the pan and a second portion joined to the first portion;

a second part adapted to be fixed to the lid and including a rear edge hinged to the second portion of the first part by at least one first pin forming a first horizontal axis;

a seat including a rear end hinged to the second portion of the first part by at least one second pin forming a second horizontal axis, said at least one second pin lying in a position lower and to the front of the at least one first pin with only one hinge device being used for securing the seat and lid to the pan; and a third part adapted to be fixed to the seat and including a rear edge hinged to the second portion of the first part by said at least one second pin of said second horizontal axis;

said second portion of the first part including two opposing vertical walls wherein the end portions of said at least one first pin project therefrom;

said second part and third part each comprise, on their rear edge, two rearwardly projecting flanges which embrace the second portion of the first part and comprise the seats for receiving said end portions of said at least one first pin and said at least one second pin.

2. The hinge device as claimed in claim 1, wherein said second part is of flat plate form and is fixed with its lower face against the upper surface of the lid;

said third part is in the form of a plate bent to an L-shape and is fixed with the upper face of its end portion against the lower surface of the seat;

covers are provided to cover the upper face of the first part and the second part and the lower face of the third part.

3. The hinge device as claimed in claim 1, wherein said second portion of the first part comprises a first upwardly extending projection defining the seat for the at least one first pin, and a second horizontally forward extending projection defining the seat for the at least one second pin, the first projection joining the second projection at a right angle.

* * * * *